United States Patent [19]

Bonsignore et al.

[11] 4,057,751

[45] Nov. 8, 1977

[54] CONTROLLED DIMMER LIGHTING SYSTEM

[75] Inventors: Salvatore J. Bonsignore, Wyckoff, N.J.; Sabert N. Howell, Huntington, N.Y.

[73] Assignee: CBS Inc., New York, N.Y.

[21] Appl. No.: 621,727

[22] Filed: Oct. 14, 1975

[51] Int. Cl.[2] ..... H05B 37/02

[52] U.S. Cl. ..... 315/316; 315/198; 315/292; 315/294; 315/317; 315/DIG. 4

[58] Field of Search ..... 315/291, 292, 294, 295, 315/299, 201, 250, 257, 287, 202, 203, 313, 316, 317, DIG. 4, 195, 198

[56] References Cited

U.S. PATENT DOCUMENTS

| | | | |
|---|---|---|---|
| 2,859,387 | 11/1958 | Ulffers | 315/201 |
| 3,527,947 | 9/1970 | Weisglass et al. | 315/287 |
| 3,534,224 | 10/1970 | Skirpan et al. | 315/291 |
| 3,733,528 | 5/1973 | Gilbreath | 315/291 |
| 3,816,797 | 6/1974 | Skirpan | 315/291 |
| 3,846,671 | 10/1974 | Johnson | 315/291 |
| 3,868,546 | 2/1975 | Gilbreath et al. | 315/291 |
| 3,878,431 | 4/1975 | Petrina | 315/201 |

FOREIGN PATENT DOCUMENTS

| | | | |
|---|---|---|---|
| 828,784 | 2/1960 | United Kingdom | 315/294 |

*Primary Examiner*—Eugene R. LaRoche
*Attorney, Agent, or Firm*—Spencer E. Olson

[57] ABSTRACT

A controlled dimmer lighting system suitable for television studios, remote television pickups and stage lighting employs small, solid state dimmer circuits of the SCR-type on a dimmer per lamp basis. Each dimmer and its associated series-connected lamp is directly connected to a respective power outlet, and a preselected group of the dimmers is controlled in unison by a common time-variable pulse generator for firing the SCRs. The common pulse generator is mounted in a lighting control console, and pulse signals for controlling the dimmers are coupled by miniature coaxial signal cables to the dimmers of the preselected group. The system eliminates the power patch panels and dimmer room required in current studio lighting systems and achieves a simplification in grid outlet wiring, resulting in a significant reduction in size and cost as compared to available studio lighting systems.

8 Claims, 3 Drawing Figures

CONTROLLED DIMMER LIGHTING SYSTEM

BACKGROUND OF THE INVENTION

This invention relates to light dimming systems, and more particularly to apparatus for controlling the intensity of electric lamps for illumination control on television and theatrical stages or in similar applications where accuracy as well as specialized control are required to effect predetermined lighting cues.

To achieve the precise control of illumination required for television studio and stage lighting often requires as many as 400 separate lamps, and it may be desirable to vary the intensity of selected lamps or banks of lamps while leaving the intensity of other lamps or banks of lamps unchanged. Typical lighting control systems in current use utilize a multiplicity of power outlets arranged in a grid on a supporting structure above the stage or studio, with each of the multiplicity of lamps connected to a respective outlet. Alternating current power for the lamps is supplied to the outlet from a central power source, and control of the intensity of the individual lamps is achieved with a plurality of dimmers housed in a large assembly of dimmer racks and may include 40 to 60 or more dimmers of 6KW to 12KW each. Multiple conductors, one from each of the dimmers, are connected to a power patch selector panel from which power-carrying conductors are wired to the grid outlets. By preselected "patching" of the conductors from the dimmers and the conductors to the grid outlets, a given dimmer is operative to control the intensity of a given lamp or group of lamps. The dimmers are controlled from a lighting control console which houses control signal generating equipment, one for each of the dimmers. Such systems are complex, cumbersome (in that a large room is normally required to house the racks of dimmers), and expensive. For example, all currently available SCR dimmers suitable for stage use, regardless of their capacity, contain all of the elements necessary to provide control from the console, one of the more expensive components of which is the control circuit. Consequently, the initial cost of each individual dimmer is high and does not decrease proportionally with a decrease in dimmer capacity; that is, the cost of a 2KW dimmer, for example, is not significantly lower than the cost of a 12KW dimmer.

SUMMARY OF THE INVENTION

It is an object of the present invention to provide a more compact, less expensive, and more convenient dimming control system than heretofore available for controlling intensity levels of a multiplicity of lamps to fulfill the needs of television and theatre.

It is another object of the invention to provide such a system whereby the user can precisely control small, and consequently less expensive, dimmers employed on a dimmer per lamp basis.

These and other objects of the invention are realized in a specific illustrative embodiment which includes a small, solid state dimmer circuit of the SCR-type for each of a multiplicity of lamps. Each dimmer and its associated lamp are connected in series and directly connected to a respective one of a multiplicity of power outlets, all of which are energized from a main power source connected to the outlets through a circuit breaker panel. The dimmers associated with a preselected group of lamps are controlled in unison by a common time-variable pulse driver mounted in a remote console, the pulse signals for firing the SCR's in the group being coupled from the console by miniature coaxial signal cables. A single pulse generator is capable of driving up to 10 or more dimmers in unison, although in most situations the preselected group might consist of a lesser number, typically six. The lamps of the system are grouped into a desired number of preselected groups, the lamps of each of which, although not necessarily located adjacent to each other, are controlled together, the console containing a number of pulse generators equal to the number of groups. Thus, the number of the control signal generators, one of the more expensive elements of the control system required to control a given number of lamps, is less than the number needed to control the same number of lamps in currently available systems, and, since the dimmers are employed on a dimmer per lamp basis, they can be of smaller capacity, and consequently of lower cost, than the dimmers employed in current systems, which may be called upon to carry the energizing current for several high wattage lamps.

DESCRIPTION OF THE DRAWINGS

A better understanding of the construction and operation of the invention will be had from the following description taken in conjunction with the accompanying drawings, in which.

DESCRIPTION OF THE PREFERRED EMBODIMENT

Figure 1:
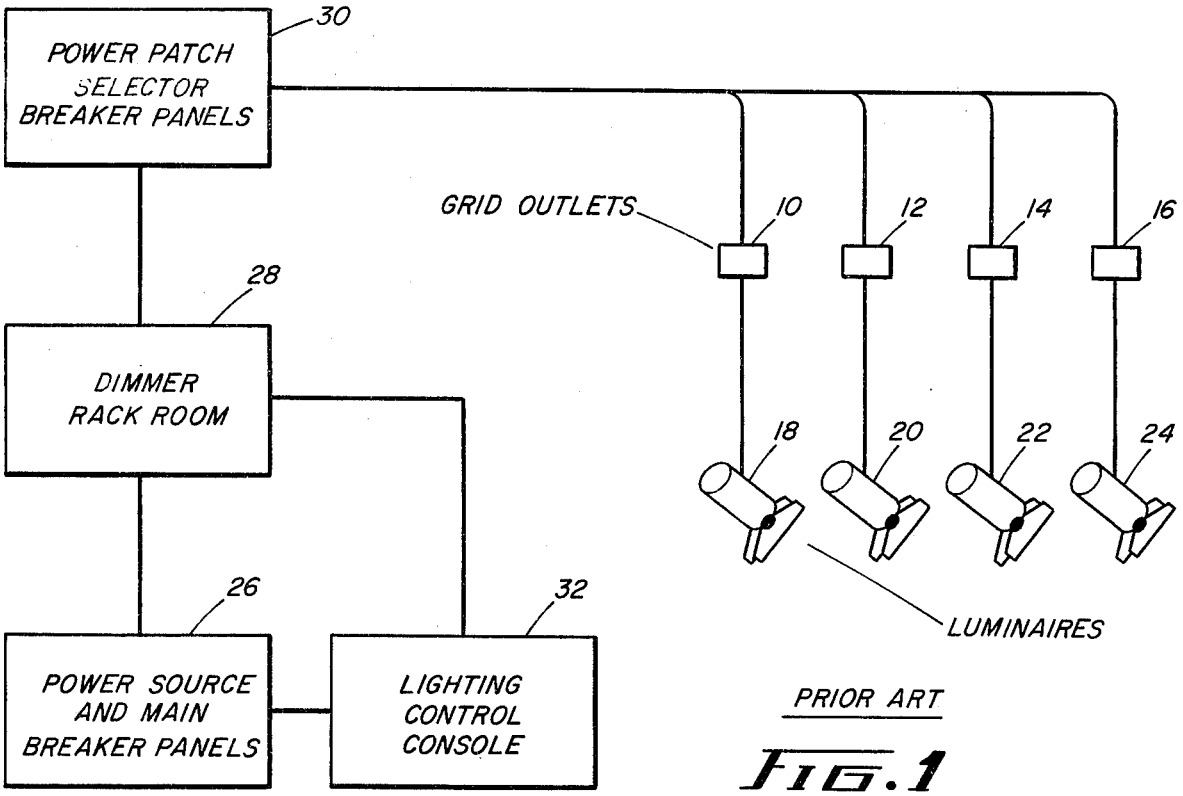
PRIOR ART FIG. 1
FIG. 1 is a block diagram of a typical prior art controlled dimmer lighting system.

FIG. 1 is a block diagram of a typical studio lighting system in current use consisting of a multiplicity of power outlets, usually supported on an overhead structure above the studio or theatre stage and arranged in a grid pattern for convenience in plugging in a comparable multiplicity of luminaires, which may be of differing wattages. For illustrative purposes, four outlets are shown at 10, 12, 14 and 16, to which four luminaires 18, 20, 22 and 24 are respectively connected. Depending on the specific lighting function of the luminaires, they may be of the same or different wattage, and it will be understood that they represent but a few of a larger number of separate lamps found in typical systems, sometimes numbering as many as 400.

Alternating current power for the lamps, normally at 60 Hz and 120 volts, is supplied by a power source 26 which includes power switch gear and circuit breakers. The source 26 supplies power to a multiplicity of dimmers, which are usually of the solid state SCR-type and mounted in a large assembly of dimmer racks 28 and placed in a separate dimmer rack room. A typical installation may include 40 to 60 or more dimmers of 6KW to 12KW each. Each of the dimmers is connected to a power patch selector panel 30 for assigning grid outlets for each luminaire to a dimmer as required for illumination of a given scene. It will be appreciated that cables having high current-carrying capacity are required for cabling the power source to the dimmer racks, from the dimmers to the patch selector, and from the patch selector to the grid outlets. Each of the dimmers is controlled by its own dimmer control circuit, all of which are contained in an operator lighting control console 32, enabling the operator to control the intensity of given ones or groups of the luminaires as determined by the assignment of outlets to a dimmer and the lighting cues for the particular program.

Figure 2:
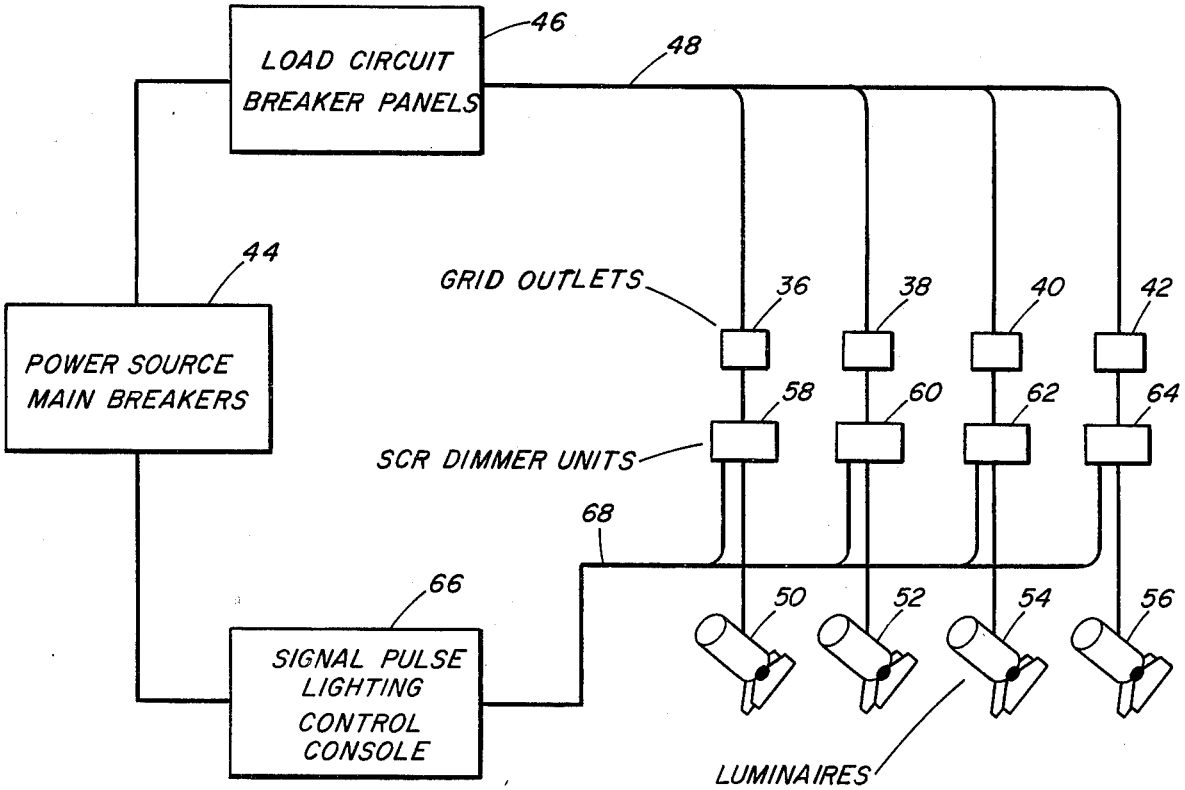
FIG. 2 is a block diagram of a controlled dimmer lighting system embodying the present invention.

The control dimmer lighting system according to the present invention, shown in block diagram in FIG. 2, includes the conventional grid of power outlets, only four of which are shown at 36, 38, 40 and 42, it being understood that a much greater number are found in the usual lighting system. The outlets are energized from a power source 44, which includes the usual main circuit breakers for the system, through load circuit breaker panels 46. Only a single cable pair is required to couple the power source 44 to the load circuit breaker panels, and since the invention contemplates the control in unison of a plurality of lamps included in preselected groups, a number of cables corresponding to the number of preselected groups are connected from the load circuit breaker panel 46 to their respective grid outlets. The diagram of FIG. 2 illustrates a group consisting of four outlets all of which are energized by a common cable 48 connected to its associated circuit breaker in the load circuit breaker panel 46.

Unlike the typical lighting system of the prior art in which a large capacity dimmer may be called upon to control the intensity of one or several luminaires, the present system employs a dimmer for each lamp. As shown, each of the lamps 50, 52, 54 and 56 of the illustrated preselected group of four lamps has associated therewith a respective dimmer unit 58, 60, 62 and 64. The dimmers are preferably of the silicon controlled rectifier (SCR) type, and since the great majority of the lamps used in a typical studio lighting system have a wattage of 2KW (although a few 5KW to 10KW lamps may also be used), and the dimmer will not be called upon to control lamps other than its associated lamp, the dimmers may be of relatively low capacity, 2KW being adequate for use with almost 98% of the lamps found in a typical system. Each dimmer is connected in series with its respective lamp and to a respective grid outlet. The individual dimmer units contain only a small pulse transformer for coupling control pulses to the dimmer, two silicon controlled rectifiers, a heat sink for the rectifiers, nd the usual inductor for suppression of SCR pulse radiation, which, too, can be smaller than in currently used dimmers because of its lower current handling requirement. Thus, the dimmer can be contained in a very small package, permitting it to be mounted near the luminaire, if desired, to be built into raceways, or to be hung in grid on the conventional overhead structure.

Figure 3:
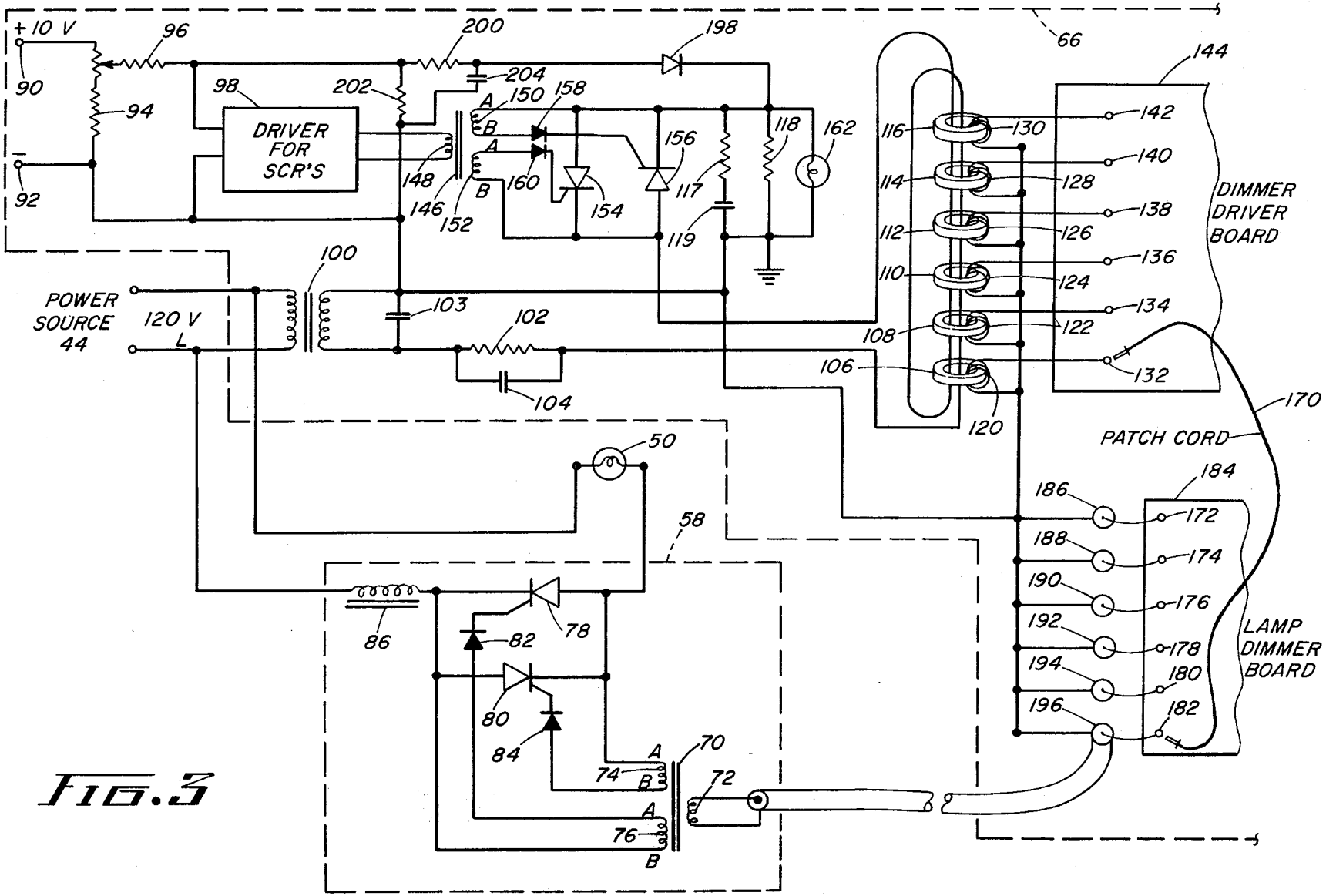
FIG. 3 is a schematic diagram of an individual dimmer and the time-variable pulse driver for controlling the same.

An important aspect of the system according to the invention is that the dimmer units associated with a preselected group of luminaires, a group of four in the embodiment shown in FIG. 2 and a group of six in FIG. 3, are slaved to the lighting control console 66 by applying the same firing control pulses to the SCR's in each of the dimmers in the group via miniature coaxial signal cables. The console 66 contains a plurality of pulse generating systems, one for each preselected group of lamps, each of which is capable of driving a sufficient number of the SCR dimmer units to suit the needs of the preselected group, typically six to 10 lamps. It will be evident that if each of the dimmer units for controlling a group of four lamps has a capacity of 3KW, it is possible to control with a single pulse generator a total wattage of 12KW (assuming that none of the four lamps has a wattage greater than 3KW), a wattage comparable to the capacity of present large dimmers. Alternatively, control of the same wattage can be obtained with a single pulse generator driving six dimmers, each with 2KW capacity, and six 2KW lamps. The required power in the individual driver pulses is essentially the same whether the dimmer being fired has a wattage of 2KW or 12KW.

The present invention eliminates the power patch panel of prior art systems, and with it the disruptive buzz and hum generated in the studio because of the concentration therein of high currents, and the need for the operator to patch line power voltage. Instead, assignment of luminaires to a given console control is achieved by a control signal patch board system located at or built into the console 66, enabling the console operator to accomplish all patching, at low voltage, by means of a small pin board.

FIG. 3 is a schematic diagram of a time-variable pulse generating system suitable for controlling the intensity of six studio lamps in unison, coupled to a representative SCR dimmer unit 58 for controlling one of the lamps 50 in a preselected group. The dimmer unit 58, which has design parameters appropriate to the wattage of the lamp 50 it is intended to control, includes a small pulse transformer 70 having a primary winding 72 and two secondary windings 74 and 76 for coupling control pulses from the pulse generator to a pair of silicon controlled rectifiers 78 and 80. Silicon controlled rectifier 78 is connected with its anode-to-cathode path between the end A of secondary winding 74 and the end B of secondary winding 76, and silicon controlled rectifier 80 is connected in inverse parallel arrangement with silicon controlled rectifier 78, that is, with its cathode-to-anode path between the aforesaid ends of the transformer secondary windings. The end A of secondary winding 76 is connected through a diode 82 to the gate electrode of silicon controlled rectifier 78 and the end B of secondary winding 74 is connected through diode 84 to the gate electrode of silicon controlled rectifier 80, the purpose of the diodes 82 and 84 being to insure application of only positive-going pulses to the gate electrodes. The anode of SCR 80 and the cathode of SCR 78 are connected to the line side L of the power source 44 (at grid outlet 36 in FIG. 2) through an inductor 86 and the cathode of SCR 80 and the anode of SCR 78 are connected to one terminal of lamp 50, the other terminal of which is connected to the neutral side of the power source 44. The purpose of the inductor 86 is to slow the buildup of current in the lamp upon rapid switching of the SCR's so as to reduce radio frequency radiation of high frequency components of electrical pulse interference into the television system with which the lighting control system is associated.

Control pulses for the dimmer unit 58 (and for up to five other dimmer units in the embodiment illustrated in FIG. 3) are provided by a time-variable pulse generating system mounted in the control console 66. A low level, unidirectional signal, for example, 10 volts, from a remote source (not shown) is applied to terminals 90 and 92, the positive and negative input terminals to the control circuit, respectively. This signal is applied across potentiometer 94 which, together with a resistor 96 is an adjustable voltage divider which constitutes the control for adjusting the intensity of the stage lighting. The control signal is applied to a variable pulse generator 98 for generating high energy, short duration pulses and may be any of several designs commercially available for use in dimmer circuits and other SCR applications. For example, circuit 98 may be a unijunction transistor trigger circuit of the kind described in an Applications Engineering note of Aladdin Electronics issued January 1965, entitled "Designing the Unijunction Trigger Circuit for SCR Applications", or as described in Skirpan U.S. Pat. No. 3,816,797. Typically, such pulse generators deliver 5 volt, 2ma pulses with a pulse width typically of 6μs or longer, with the time delay of its firing inversely proportional to the controlling input current as determined by the setting of potentiometer 94.

The pulses delivered by conventional pulse generators of this type not having sufficient energy to be transmitted without amplification to a remotely located dimmer unit, and since, if six dimmer units were to be driven from a common driver six separate amplifiers would be required, the pulses from the driver 98 are utilized to generate a plurality of synchronized pulse trains of sufficient energy to be transmitted without amplification over miniature coaxial pulse signal cables to remotely located dimmer units.

To this end, AC power from the source 44 is stepped down to thirty volts and coupled to the console by transformer 100, it being essential that the console and the stage lamps be energized from the same source to ensure proper phase relationship between the control pulses and the AC power being controlled. The secondary winding of transformer 100 is connected through the parallel-connected resistor 102 and capacitor 104, through several turns of wire threading a plurality of torroidal ferrite cores 106 through 116 to constitute a primary winding for all of the cores, through a pair of silicon controlled rectifiers 154 and 156 and then through resistor 118 to the common ground side of the secondary winding. Each of the cores 106 through 116 has a separate secondary winding 120 through 130, respectively, one terminal of each being connected to a respective terminal 132 through 142 on a dimmer driver patch board 144. Thus, the ferrite cores constitute six transformers having a common primary winding and individual secondary windings.

Control pulses for the remote dimmer units are produced in the secondary windings of the ferrite cores by switching the alternating current in the primary winding in timed relationship with the trigger pulses produced by the driver circuit 98. This is accomplished by coupling the drive pulses from circuit 98 through a pulse transformer 146 having a primary winding 148 and two secondary windings 150 and 152 to trigger an SCR circuit including silicon controlled rectifiers 154 and 156. The anode-to-cathode path of SCR 154 is connected between the A terminal of secondary winding 150 and the B terminal of secondary winding 152, and SCR 156 is connected in inverse parallel arrangement with SCR 154; that is, with its cathode-to-anode path between the aforesaid terminals of the secondary windings. The terminal B of secondary winding 150 is connected to the gate electrode of SCR 156 via diode 158, and the gate electrode of SCR 154 is connected to the A terminal of secondary winding 152 via diode 160, the diodes being provided to ensure that only positive pulses are supplied to the gate electrodes of the two SCR's. The anode of SCR 154 and the cathode of SCR 156 are connected to the 30 volt AC source 100 through the primary turns of the ferrite cores 120 - 130. Thus, the current in the primary winding passes through the SCR's 154 and 156 and returns to the source through resistor 118 and an indicator lamp 162 connected in parallel therewith. The intensity of the lamp 162, which is mounted on the console, is controlled by the phase relationship of the drive pulses from driver 98 applied to transformer 146 and the occurrence of the application of each half cycle of AC line voltage from source 100 to the SCR's 154 and 156, and thus provides to the console operator an indication of the relative brightness of the stage lighting lamps which, it will be seen, are controlled by the same phase relationship. Lamp 162 may be a 28 volt lamp, and since the currents necessary to energize the ferrite core transformers is relatively small, the silicon controlled rectifiers 154 and 156 may be very small, a capacity of one to two amperes being sufficient.

The described connections of the silicon controlled rectifiers 154 and 156 to the console AC voltage provides synchronization of the occurrence of a gating pulse in each of secondary windings 150 and 152 and the occurrence of the application of a half cycle of AC console voltage to the silicon controlled rectifiers. Thus, silicon controlled rectifiers 154 and 156 are gated into conductivity at successively occurring half cycles of the AC voltage, the angle of their gating, that is, the time of their firing in a half cycle, depending upon the time of the triggering of the unijunction transistor contained in the driver circuit 98. Because the inductance of the ferrite cores 106 through 116 precludes a buildup of current sufficiently fast to follow the essentially instantaneous switching of the SCR's when gated into conductivity, the current inrush in the primary winding of the ferrite cores induces a sharp positive-going pulse in each of the secondary windings of the ferrite cores, followed by a negative-going overshoot. These positive-going pulses are synchronized with the trigger pulses from driver circuit 98 and when applied to the dimmer circuit 58, which is powered from the same source as that supplying the console and utilized in the generation of the trigger pulses, will gate the SCR's 78 and 80 into conductivity at the same time in successively occurring half cycles that the SCR's 154 and 156 are fired. It will be understood that the primary winding 72 in the dimmer unit 58 and the windings of the ferrite cores are all so polarized as to produce positive firing pulses at the B end of windings 74 and 76 upon occurrence of a positive going sine wave potential at the anodes of SCR's 78 and 80.

A resistor 117 and a capacitor 119 series connected across the lamp 162 together with resistor 102 and capacitor 104 and a capacitor 103 connected across the secondary winding of transformer 110 serve to increase the amplitude of the pulses produced in the secondaries of the ferrite cores.

The pulses generated in the ferrite cores are, as indicated earlier, coupled to respective terminals of a dimmer drive patch board 144 and are there available for selective connection, as by a patch cord 170, to any one of the illustrated six pin board terminals 172 through 182 of a lamp dimmer patch board 184, which terminals are, in turn, connected to the inner conductor of six miniature coaxial signal cables 186 through 196, respectively, the outer conductors of which are connected together and to the common ground of the secondary windings of the ferrite cores. In FIG. 3, coaxial cable 196 (which corresponds to conductor 68 in FIG. 2) is shown connected to the primary winding 72 of pulse transformer 70 in the dimmer unit 58 for coupling pulses thereto for controlling the firing of SCR's 78 and 80 of the dimmer unit; it will be understood that the other five coaxial cables 186 through 194 (or selected ones of them) would be connected to the pulse transformers of the dimmer units associated with the other lamps of a predetermined group, the intensity of which it is desired to control in unison. The described connections of the dimmer driver board and the lamp dimmer board enables the console operator to patch, at low voltage, selected lamps to a given console control channel, thus eliminating the above-discussed hazard and other disadvantages of the power patch panel used in prior art systems.

Reverting to the pulse generating system itself, the operation of the trigger circuit containing SCR's 154 and 156 is stabilized by a feedback connection from the ungrounded terminal of resistor 118 through rectifier 198 and a voltage divider network consisting of resistors 200 and 202 and a smoothing capacitor 204 connected across the input terminals to the driver circuit 98.

It is to be understood that although the time-variable pulse generating system of FIG. 3 has the capability of controlling six separate dimmers in unison, on a dimmer per lamp basis, the described system is capable of producing up to ten or more individual control pulse train outputs, and, of course, a number less than six may be used. It is to be understood, also, that although the system of FIG. 3 is a preferred technique of generating control pulses for a plurality of dimmer units, other systems may be employed without departing from the spirit of the invention of controlling a plurality of dimmer units, on a dimmer per lamp basis, from a common control channel. In this connection, it will be recognized that a single control panel is illustrated in FIG. 3 and that a typical control console would contain a multiplicity of such control channels, equal in number to the desired number of groups of lamps used in a particular lighting system.

The dimmer per lamp system of the invention has the important advantage of portability in that the individual, relatively small capacity dimmers may be hung in a grid, stacked at one side of the studio, located in another room, attached near the individual luminaire or built into raceways in the overhead structure. The need for the large dimmer room associated with prior art installations is eliminated, thereby effecting a saving of the rental of such a room. Additionally, the power patch panel of prior art systems is eliminated, thereby providing additional valuable space where it counts most, namely, in the studio. Elimination of the power patch panel also eliminates the heavy concentration of high currents which has been a source of disruptive buzz and hum in the studio. The acoustic noise of the smaller dimmer, possible in a dimmer per lamp system, is lower than that of most commercially available dimmers, the level being sufficiently low to permit their use in the studio. The system is safer than conventional systems because all control is at the low voltage of the console, eliminating the requirement for the operator to patch line power voltage, and provides greater operating economy since all patching can be accomplished by the console operator by means of small pin boards. Moreover, the invention permits remote pickups to be set up and dismantled more quickly than with existing systems, and most importantly, small remotes can now have a dimming facility which has been previously denied them. Large remotes no longer have to carry large, bulky equipment in order to provide a proper patching capability.

Apart from the above-enumerated advantages, the invention provides a significant cost advantage over prior art systems. A comparison between the cost of equipping at current prices a medium-size studio having an area of 6100 square feet and a grid height of 18 ½ feet with current installation practices and using the dimmer per lamp system of the invention, shows a saving of approximately 30% using the dimmer per lamp system.

From the foregoing, it is seen that a studio lighting system constructed in accordance with the principles of the invention, has many advantages in terms of cost savings, space savings, labor savings and time savings, and makes available to small remotes a dimming facility which has not been previously available.

As various changes may be made in the form, construction arrangement of the described system without departing from the spirit and scope of the invention, and without sacrificing any other advantages, it is to be understood that the foregoing description is to be interpreted as illustrative and not in a limiting sense except as set forth in the following claims.

We claim:

1. In a controlled lighting system for television studios and the like including an AC voltage source for supplying voltage to a multiplicity of power outlets arranged in a grid on an overhead supporting structure, a multiplicity of lamps supported on overhead supporting structure, and a lighting control console disposed remotely from said outlets and said lamps including a source of control signal voltage, apparatus for variably controlling the current from said AC voltage source to a lamp load consisting of a preselected group of *n* of said lamps, wherein *n* is two or more, said apparatus comprising:

*n* pulse-controlled dimmer units, one each of which is connected between one of said power outlets and a respective different one of said *n* lamps and supported proximate its associated lamp, each of said dimmer units having a current capacity appropriate to the wattage of its corresponding lamp and consisting essentially of a pair of gate controlled rectifiers having anode, cathode and gate electrodes connected with their anode-to-cathode paths in inverse parallel arrangement between one terminal of said AC voltage source and one terminal of the associated lamps, and pulse transformer means for applying pulses to said gate electrodes for rendering said rectifiers alternately conductive in successively occurring half cycles of said AC voltage source, time-variable pulse generating means disposed in said control console and connected to and operative in response to said source of control voltage to generate a pulse train output in which successive pulses occur during discrete half cycles of the output voltage from said AC voltage source, and pulse-coupling means connected between said pulse generating means and the pulse transformer means in each of said *n* dimmer units for supplying said pulse train output to each of said *n* dimmer units, thereby to control in unison, the current supplied from said AC voltage source to each of the *n* lamps in said group.

2. Apparatus according to claim 1 wherein said pulse generating means includes transformer means for producing $n$ like trains of pulses corresponding pulses in each of which are in synchronism, and wherein said pulse-coupling means includes $n$ pulse signal cables each coupled to the pulse transformer means in a respective different one of said $n$ dimmer units, and signal patching means for coupling said $n$ trains of pulses one each to a selected different one of said pulse signal cables.

3. Apparatus according to claim 2, wherein said means for producing $n$ trains of pulses comprises:

$n$ pulse transformers, each having a secondary winding and common primary winding means connected to said AC voltage source, and switching means connected in series with said primary winding means and operative to switch the current in said primary winding means supplied by said AC voltage source at discrete times during successive half-cycles thereof determined by said control voltage thereby to generate a pulse train the pulses of which are induced in each of said secondary windings.

4. In a lighting system for television studios and the like, apparatus for variably controlling the current from an AC source supplied to a lamp load consisting of a group of $n$ lamps supported on overhead supporting structure, wherein $n$ is two or more, said apparatus comprising:

an AC source connected to supply voltage to a multiplicity of power outlets arranged in a grid on overhead supporting structure, $n$ pulse controlled dimmer units, one each of which is connected between one of said power outlets and a respective different one of said lamps and supported proximate its respective lamp, each of said dimmer units consisting essentially of a pair of gate controlled rectifiers having anode, cathode and gate electrodes connected with their anode-to-cathode paths in inverse parallel arrangement between one terminal of said AC source and one terminal of its associated lamp, and pulse transformer means for applying pulses to said gate electrodes for rendering said rectifiers alternately conductive in successively occurring half cycles of said AC source, a control console disposed remotely from said power outlets and said lamps and containing a source of control signal voltage and time-variable pulse generating means controlled by said control signal voltage for generating $n$ like trains of pulses in each of which successive pulses occur during discrete half cycles of the AC voltage supplied to said power outlets, and corresponding pulses are in synchronism, and pulse-coupling means connected to couple one each of said trains of pulses from said pulse generating means to the pulse transformer means in a respective different one of said $n$ dimmer units, thereby to control in unison, in accordance with said control signal voltage, the current supplied from said AC source to each of the $n$ lamps in said group.

5. Apparatus according to claim 4, wherein said pulse-coupling means includes $n$ pulse signal cables each connected to the pulse transformer means in a respective different one of said $n$ dimmer units, and signal patching means for coupling said $n$ trains of pulses one each to a selected different one of said pulse signal cables.

6. Apparatus according to claim 4, wherein said time-variable pulse generating means comprises:

$n$ pulse transformers, each having a secondary winding and common primary winding means connected to said AC source, and switching means connected to switch the current supplied by said AC source to said primary winding means at discrete times during successive half cycles thereof determined by said control signal voltage thereby to produce in said primary winding means a pulse train the pulses of which are induced in each of said secondary windings.

7. Apparatus according to claim 6, wherein each of said transformers comprises a core having a secondary winding wound thereon and connected to said pulse-coupling means, and wherein said primary winding means includes a winding coupled to all of said cores.

8. Apparatus according to claim 7, wherein said switching means includes a pair of gate controlled rectifiers having anode, cathode and gate electrodes connected with their anode-to-cathode paths in inverse parallel arrangement between one terminal of said primary winding means and one terminal of said AC source, and means including a pulse transformer for applying driving pulses to said gate electrodes at discrete times determined by said control signal voltage for rendering said rectifiers alternately conductive in response to said driving pulses.

* * * * *